United States Patent [19]

Rogalski et al.

[11] Patent Number: 4,474,228

[45] Date of Patent: Oct. 2, 1984

[54] CLOSED CYCLE VAPORIZATION COOLING SYSTEM FOR UNDERWATER VEHICLE INNER-TO-OUTER HULL HEAT TRANSFER

[75] Inventors: Robert D. Rogalski, Riva; George F. Wilhelmi, Crofton, both of Md.

[73] Assignee: The United States of America as represented by the Secretary of the Navy, Washington, D.C.

[21] Appl. No.: 411,062

[22] Filed: Aug. 24, 1982

[51] Int. Cl.[3] ..... B63J 2/12

[52] U.S. Cl. ..... 165/44; 165/41; 165/104.21; 165/104.14

[58] Field of Search ..... 165/41, 44, 104.14, 165/104.21

[56] References Cited

U.S. PATENT DOCUMENTS 1,862,282 6/1932 Schmidt ..... 165/44

3,572,426 3/1971 Edwards ..... 165/104.21

3,783,935 1/1974 Simmons et al. ..... 165/44

*Primary Examiner*—Albert W. Davis, Jr.

*Attorney, Agent, or Firm*—R. F. Beers; L. A. Marsh

[57] ABSTRACT

A closed cycle vaporization cooling system for an underwater vehicle's inner-to-outer hull heat transfer having a low pressure freshwater circulating loop means for collecting and cooling waste heat from inside the vessel by an evaporator means located inside the vessel and so configured to operate under all conditions, an adiabatic zone within the loop for conveying vaporized working fluid to a condenser means located outside the underwater vehicle's pressure hull utilizing a chimney effect free-flooded seawater heat sink wherein cold seawater flows from bottom to top of the heat sink over the condenser means, and a condensate means for condensing and returning the condensate to the evaporator means.

14 Claims, 19 Drawing Figures

SLANTED CONDENSER DESIGNS
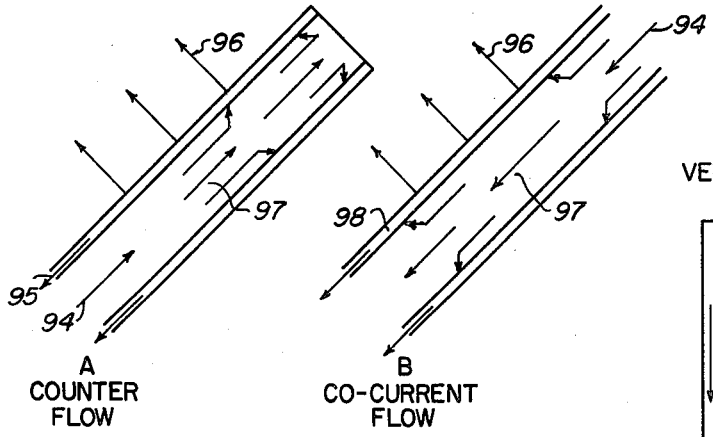
VERTICAL CONDENSER DESIGNS
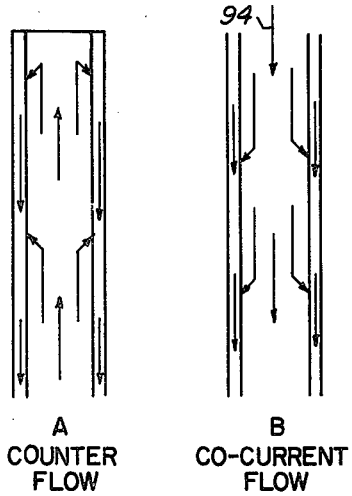
INVERTED V CONDENSER DESIGN
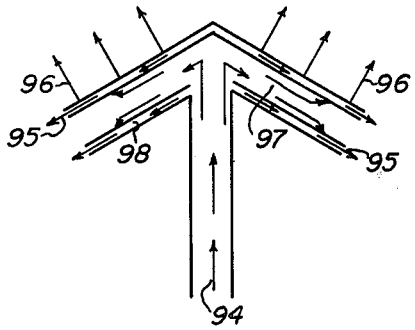
FIG. 10
V CONDENSER DENSIGNS
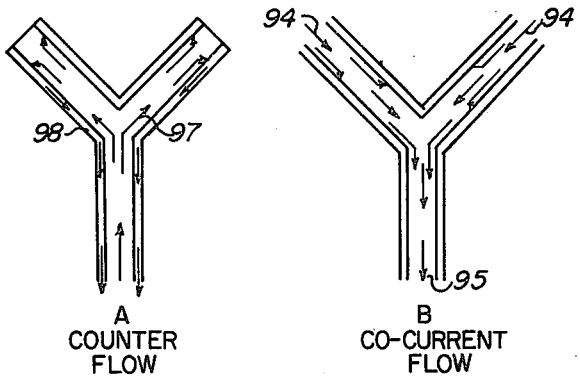

CLOSED CYCLE VAPORIZATION COOLING SYSTEM FOR UNDERWATER VEHICLE INNER-TO-OUTER HULL HEAT TRANSFER

BACKGROUND OF THE INVENTION

1. Field of the Invention

This invention is directed to a closed-cycle vaporization cooling system (CCVCS) for transferring underwater vehicle auxiliary system heat loads from inside the pressure hull of the submarine to seawater near the outer hull.

2. Description of the Prior Art

Existing apparatus and method used for underwater vehicle auxiliary seawater heat rejection to the ocean involves pumping relatively large quantities of seawater through one or several large inlet penetrations to one or several heat exchangers. Newer designs use one large auxiliary seawater (ASW) exchanger instead of several smaller ones. Such newer designs require increasing the size of the entire ASW system including the seawater connected pumps which also increases their noise signature. Also, hull penetration size grows because the larger systems with larger heat exchangers require larger flow rates which must be accommodated by increased cross-sectional flow areas since fluid velocity is limited by erosion and noise considerations. All seawater piping systems on submarines are critical systems requiring space within the pressure hull, adding significant weight to the ship, consuming energy, and generating noise. Moreover, marine fouling of seawater-cooled heat exchangers and other components of the seawater cooling systems in submarines is an occasional problem which can become severe when the ship is operating in warm water. Submarine-type underwater vehicles with greater depth capability will require fewer and smaller hull penetrations for safer operation.

SUMMARY OF THE INVENTION

The present invention provides a closed cycle vaporization cooling system (CCVCS) for an underwater vehicle inner-to-outer hull heat transfer comprising a low pressure fluid circulating loop means for collecting and cooling waste heat from various machinery and equipment in the underwater vehicle's auxiliary cooling system, an evaporator reservoir means configured so as to operate under all conditions of the underwater vehicle's motion and being a pressure vessel located inside the underwater vehicle and having a bundle of manifolded heat pipe evaporator tubes for transferring heat from hot fluid to the heat pipe's working fluid through its manifolded evaporator section means, an adiabatic zone means located between said evaporator means and a condenser means located outside the underwater vehicle pressure hull for conveying vaporized working fluid to said condenser means, a condenser means located external to the pressure hull of the underwater vehicle and contained within a free-flooded seawater heat sink reservoir recessed or external to the outer hull with a louvered or scooped top and bottom opening or scooped in the fore and aft directions and hull shaped for transferring heat to the seawater from said working fluid, and a condensate means located partially within said condenser means for condensing and returning said condensate to said evaporator means.

OBJECTS OF THE INVENTION

A prime object of the present invention is to provide a CCVCS for an underwater vehicle to serve as an alternative means of heat release through a single penetration (sealed) that is equal to or smaller than the two hull penetrations required for a conventional seawater cooling system.

A further object of the present invention is to provide less noise signature for the underwater vehicle.

A further object of the present invention is to provide a two-phase flow apparatus with manifolded evaporator and condenser sections for an underwater vehicle through hull heat rejection to the ocean of auxiliary system heat loads and other heat loads determined as handleable by the system.

Another object of the present invention is the elimination of seawater cooling of the auxiliary system heat exchangers in the hull.

Another object of the present invention is the CCVCS fluid that is rejecting heat to the ocean is isolated from submergence pressures by a pressure barrier.

Still another object of the present invention is the use of a free-flooded channel or section to cool a two-phase flow apparatus rejecting heat loads from inside the underwater vehicle to the outside seawater.

Other objects will become apparent from the following description and claims.

DESCRIPTION OF THE DRAWINGS

The specification concludes with claims particularly pointing out and distinctly claiming the subject matter of the present invention; however, this invention may be better understood from the following description, taken in conjunction with the following drawings, in which:

FIG. 10 illustrates other condenser geometry configurations showing vapor and liquid flow pattern variations as utilizable in this invention.

DETAILED DESCRIPTION

Figure 1:
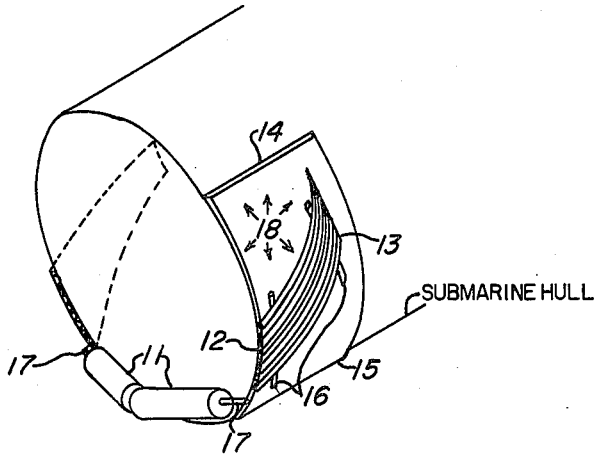
FIG. 1 is a partial cross-sectional view of the location of a closed cycle vaporization cooling system (CCVCS) for an underwater vehicle auxiliary heat removal as used in the present invention.

FIG. 1 illustrates a closed-cycle vaporization cooling system (CCVCS) for an underwater vehicle, a submarine in this instance, and illustrates a heat source reservoir and compact evaporator internals 11, condenser heat pipe header 12, condenser heat pipe section branches 13, louvered chimney top, free-flooded seawater hull section outtake 14, louvered chimney bottom 15, structural supports 16 for the free-flooded seawater hull section, hull valve 17, and the recessed or external free-flooded seawater hull section heat sink chamber 18 being coated with antifoulant material.

Figure 2A:
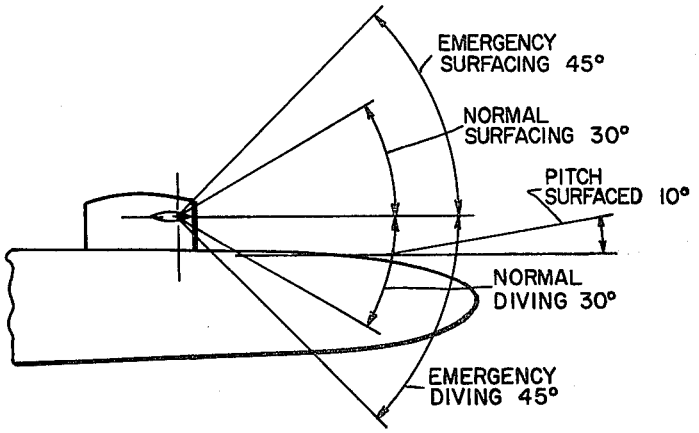
FIGS. 2A and 2B illustrate roll, pitch, list/heel, and diving/surfacing trim angles, for an underwater vehicle, particularly a submarine's angles and motion, and other requirements that the CCVCS must be so configured to operate under such conditions.
Figure 2B:
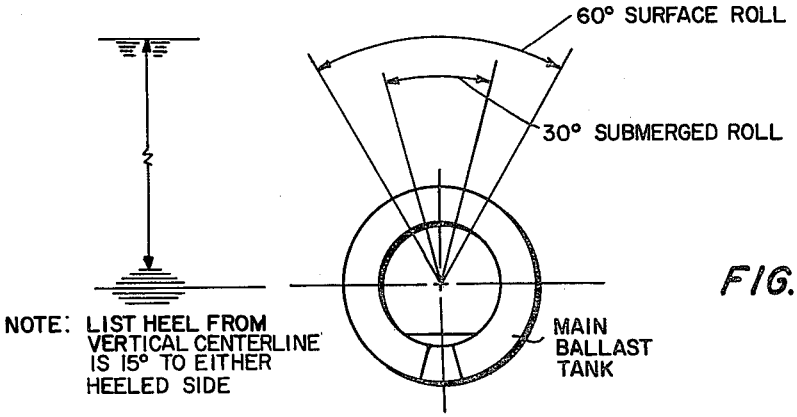

FIGS. 2A and 2B illustrate for an underwater vehicle, a submarine in this instance, the trim angles and motions that are required to be withstood by the CCVCS.

Figure 3:
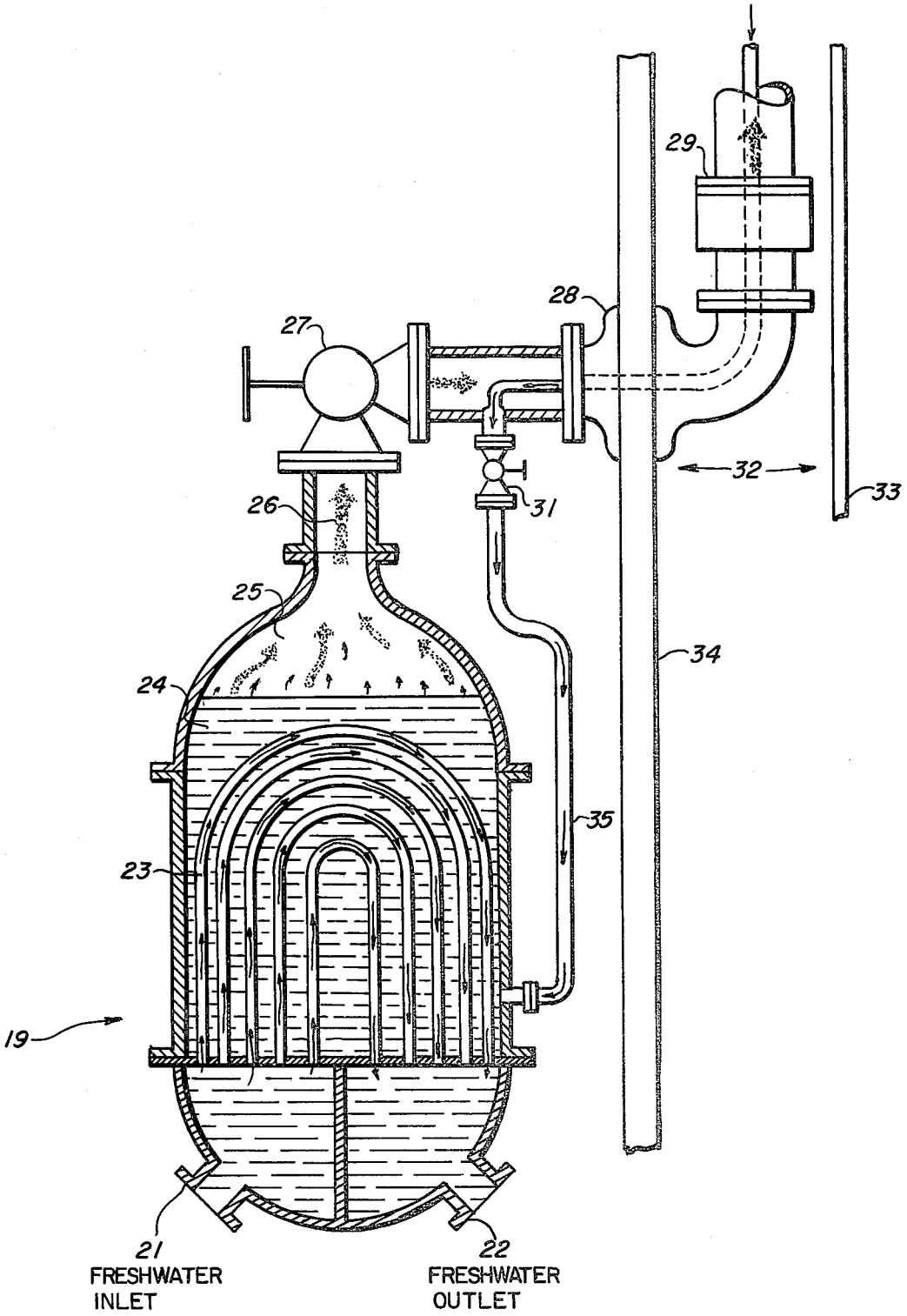
FIG. 3 is an enlarged view of an evaporator of the CCVCS.
Figure 4:
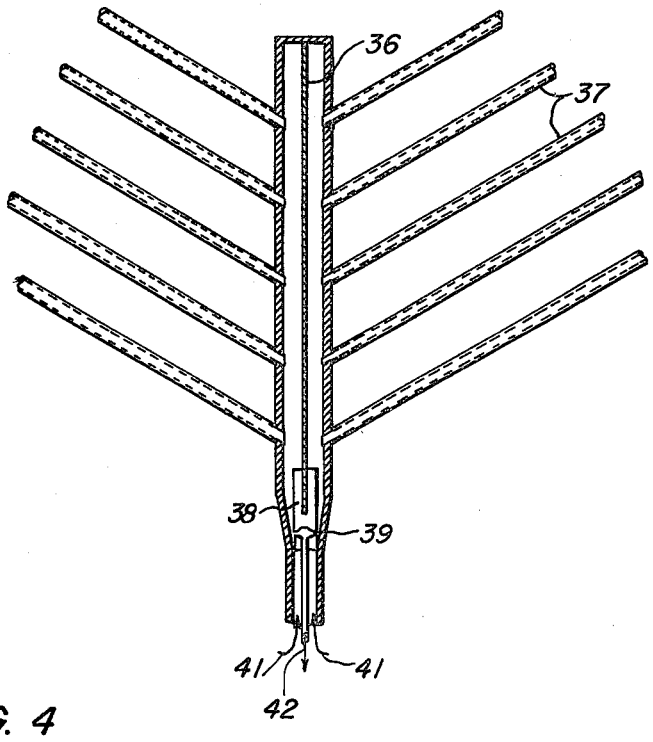
FIG. 4 is another variation utilizing a more compact arrangement to obtain the same functional results of redundant condenser section header manifolds wherein vapor flow sections are shown separated by a baffle plate which diverts the vapor flow from the single pipe adiabatic section to the right and left side groups of branch tubes, internally wicked, as shown.
Figure 5:
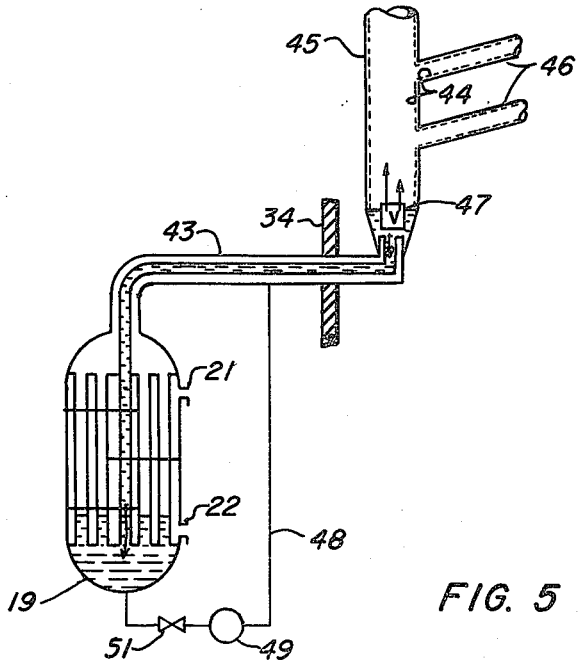
FIG. 5 is a cutaway schematic, enlarged view of the CCVCS evaporator with other components of the system as used in the present invention.
Figure 6B:
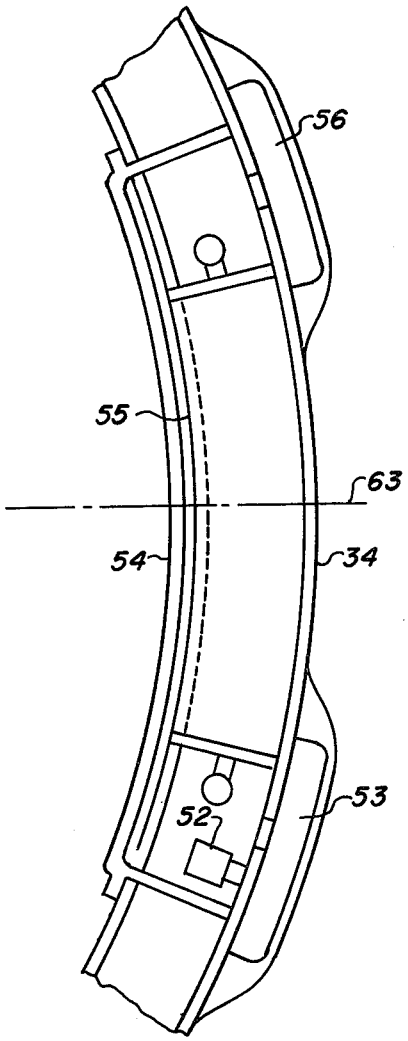
FIGS. 6A and 6B are cutaway schematic views of the straight heat pipe heat exchanger for localized auxiliary system heat loads arranged in a bundle such that their evaporator ends can be heated by in-board, low-pressure, hot freshwater and their condenser ends can be cooled by ocean seawater allowed to freely flow through a modified inner frame space, FIG. 6B specifically illustrates section along A-A' of 6A (covers removed to improve clarity of the illustration)
Figure 6A:
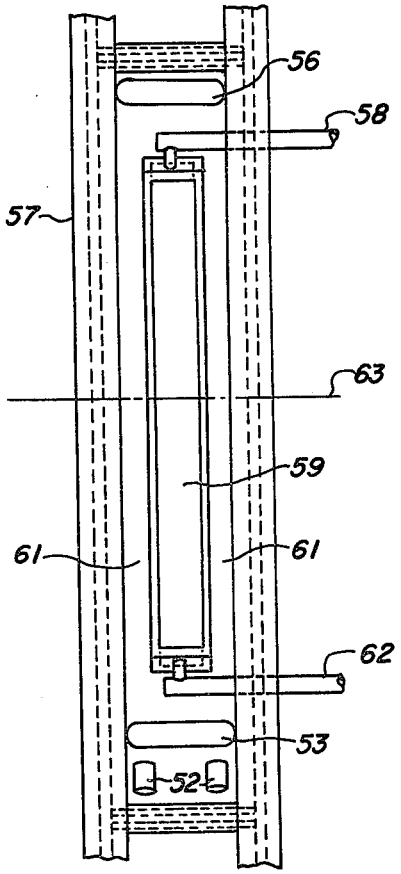

FIGS. 3, 4, and 5 illustrate an evaporator reservoir means 19 of the invention which is a pressure vessel containing a reservoir of working fluid, which under steady-state conditions is constantly vaporizing as heat is being transferred through a bundle of heat transfer tubes 23, which can have enhanced outside surface if required, containing circulating hot freshwater. Condensate 24 is continuously returned to evaporator reservoir means 19 through an artery or small diameter tube 35 which can have an isolation valve 31. The working fluid vapor 25 is vaporized in evaporator reservoir means 19 and vapor flow 26 converges at the heat of evaporator reservoir means 19 into a pipe that forms part of adiabatic zone 43 shown in FIG. 5. A hull valve 27 is utilized as an additional safety feature of the system. Adiabatic zone 43 penetrates pressure hull 34 and conveys vaporized working fluid through hull penetration 28 and condenser heat pipe header 12 to condenser 45 of FIG. 5. Condenser heat pipe header 12 also acts as a manifold for the transfer of the working fluid to and from branch tubes 46 of FIG. 5 where this fluid transfer is done through small internal channels or wicked branch tubes 37 of FIG. 4 for the liquid phase and through the remaining larger cross-sectional internal area for the vapor phase flow. Heat is transferred to the seawater from condenser heat pipe header 12 and branch tubes 46 as shown in FIG. 5 and wicked branch tubes 37 as shown in FIG. 4. Branch tubes 46 can be vertical for excellent condensate return. Condenser heat pipe header 12 and condenser means 45 branch tubes 46 and wicked branch tubes 37 are contained in a free-flooded seawater heat sink chamber 18 of FIG. 1. FIG. 4 illustrates a detailed variation regarding outer hull condenser 45 showing flow separation baffle plate 36, internally wicked branch tubes 37, vapor channel 38, liquid condensate return 39, vapor flow 41 and liquid return 42. FIG. 5 further illustrates a condenser heat pipe header (thermosyphon main header) 12 variation without showing condensate return artery 35 of FIG. 3 and its associated artery isolation valve 31 in alternate piping 48. FIG. 5 further illustrates separator 47 located between condenser heat pipe header 12 and adiabatic zone 43, but without showing hull valve FIGS. 6A and 6B illustrate in detail recessed or external designed seawater free-flooded hull section antifoulant coated heat sink chamber 18 wherein seawater booster pumps 52 can be utilized, as and if required, for forcing cold seawater into intake scoop 53, cold channel cover 54 and hot channel cover 55 and bolted and sealed to withstand pressures in all trim angles and motions required. Cold seawater enters intake scoop 53 and exits seawater exit 56, and fresh hot water enters inlet 58 and exits outlet 62. Hot water channel 63 and seawater channel 61 are depicted in detail illustrating the operable heat exchange in heat sink chamber 18. Preferably, hot channel is allotted two-thirds of the space.

Figure 7:
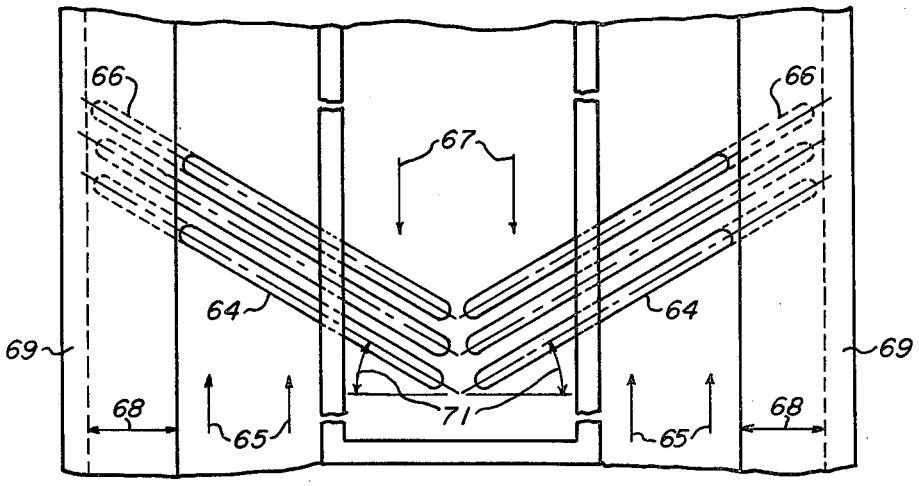
FIG. 7 illustrates a small segment of the heat pipe arrangement of the heat exchanger.

FIG. 7 illustrates a small section, in one instance, detail of branch pipe arrangement of heat exchange of heat sink chamber 18 wherein the allotted hot and cold space is illustrated, branch tubes either short tubes 64 or long tubes 66, are utilized as required. Angle 71 of the tubes is necessary for enhanced gravity flow. Frame I-beam flange 68 and hull frame 69 are depicted to show perspective. The use of interframe space, as illustrated, and internally hardened to extend pressure hull 34 inboard to flange 68 of the I-beam, is a novel means of providing small chimney channels or heat sinks for assisting in the vaporization cooling system.

Figure 8A:
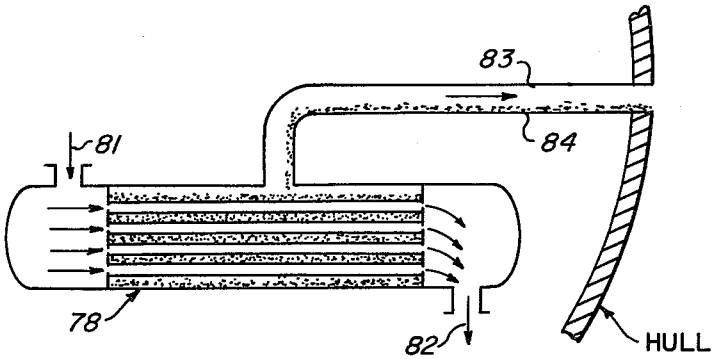
FIGS. 8A and 8B are cutaway schematic views of the boiler-type and tube and shell-type evaporator section of the CCVCS respectively.
Figure 8B:
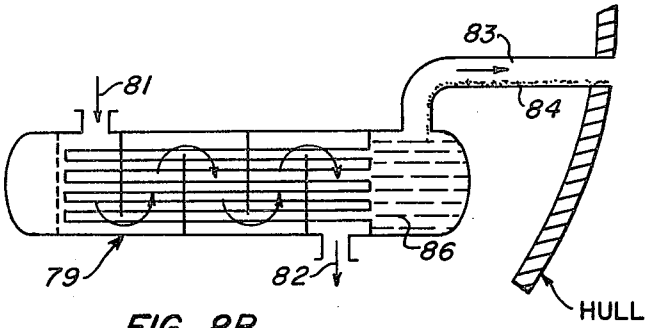
Figure 8:
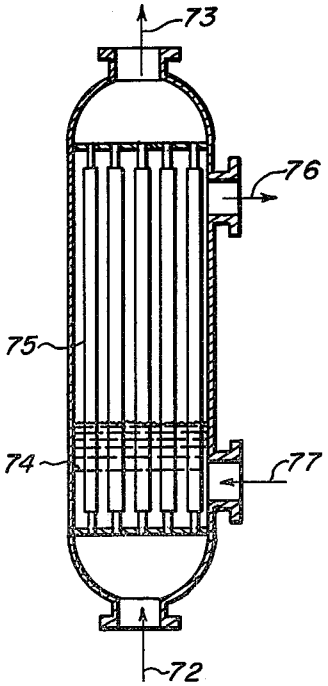
FIG. 8 is a cutaway schematic view of an alternative capillary rise tube evaporator for CCVCS in which the thin film is drawn up from a reservoir (not shown) by capillary action along the outside of the tubes in a modified tube and shell exchanger.

FIGS. 8, 8A and 8B illustrate an alternative capillary rise tube evaporator reservoir means 11 wherein hot fresh water enters inlet 72 and exits cooler at exit 73 and liquid 74 in the form of a thin film is drawn up from evaporator reservoir means 11 by capillary action along the outside of tubes in a modified tube-and-shell heat exchanger as illustrated in FIG. 8B. FIG. 8A illustrates a pool boiler type evaporator reservoir means 11 arrangement wherein inlet 81 and outlet 82 accommodate the water circulation and exchanging its heat load as illustrated at vapor 83 and condensate 84 depiction. FIG. 8B illustrates a tube and shell evaporator reservoir means 11 arrangement yielding comparable heat exchange as in FIGS. 8, and 8A.

Figure 9A:
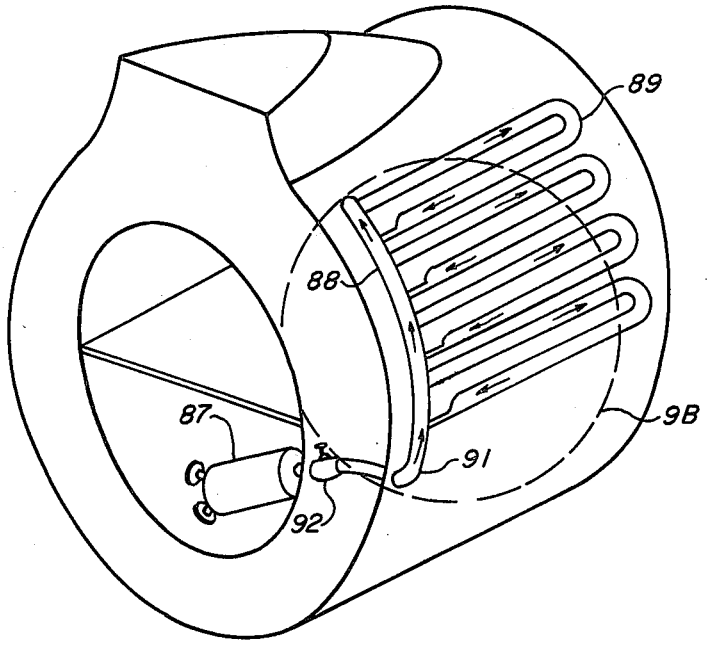
FIGS. 9A and 9B illustrate cutaway schematic views of other alternative designs as used in the present invention to improve heat transfer coefficient while also stabilizing condensate return feed during underwater vehicle movement.
Figure 9B:
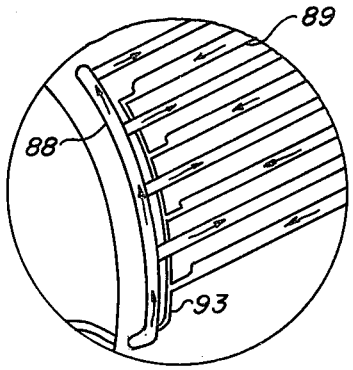

FIG. 9A illustrates a thermosyphon hair-pin condenser arrangement and FIG. 9B illustrates a similar condenser arrangement except for having a separate condensate return tube 93 of the invention. Each illustrates an evaporator reservoir section 87, vapor header 88 and condenser tubes 89. Such type arrangement can be utilized singly as needed for heat exchange for small areas or situated in banks of two or more whenever needed. Channeling or wicking are utilized in vapor header 88 and condenser tubes 89 as desired for greater efficiency.

FIG. 10 illustrates various condenser configurations, all of which can be used in the invention, depending only upon efficiency review for type of use (vapor and liquid flow pattern variation) and for various underwater vehicles utilized.

Figure 11A:
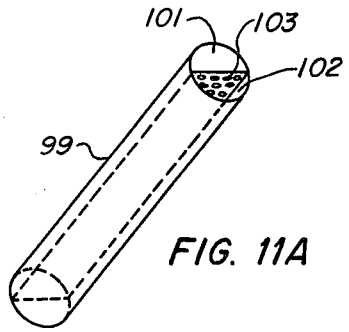
FIGS. 11A, 11B, and 11C illustrate other vapor separator types as utilizable in this invention for converting a reflux mode to a concurrent flow mode.
Figure 11B:
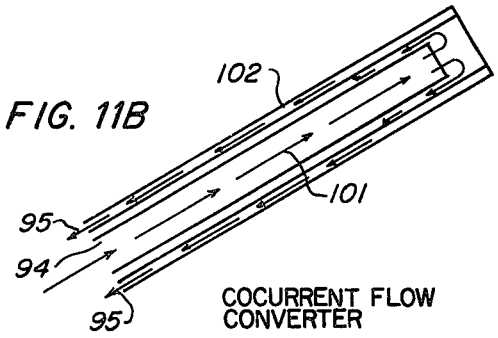
Figure 11C:
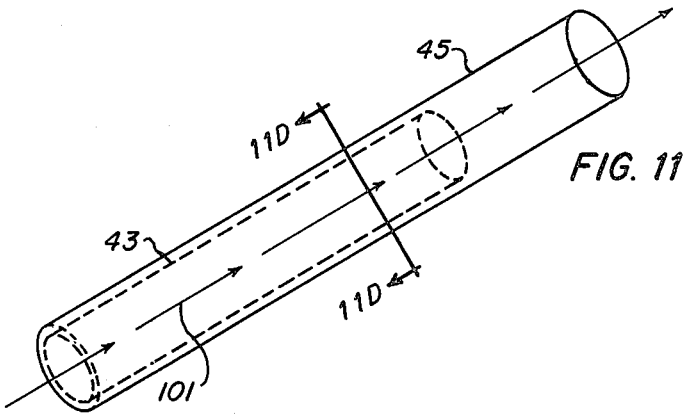
Figure 11D:
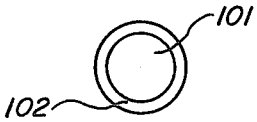
FIG. 11D specifically illustrates a section AA of FIG. 11C.

FIGS. 11A, 11B, and 11C illustrate various heat pipe vapor separator designs useful in the inventions, again depending only upon efficiency required for intended use.

In a boiler-type evaporator means 11, the heat given up by the auxiliary fresh water causes the working fluid to boil, collecting near evaporator means 11 top, vapor then flows through hull penetration 28 to condenser means 45 and into branch tubes 46, condenses. i.e., vapor 83 gives up its latent heat to heat sink 18 and condensate 84 then returns by gravity or with pump assist to evaporator reservoir means 11. In the tube and shell type evaporator 79 illustrated in FIG. 8B, the auxiliary fresh water is circulated around a bundle of evaporator 79 tubes manifolded into a common heater. Additional channels are added as required for large heat loads and for uniform distribution to all tubes of the working fluid.

Mechanical augmentation can be utilized, as desired, such as, roughened surfaces, porous surfaces, fluting of tubes, etc. One preferable way observed in this invention is to utilize external bonded porous surface and internal single helix flutes.

The heat transfer material for the CCVCS may be selected from many different metals and alloys. (Copper-nickels (70-30), titanium, and Inconel 625 are candidates.) Copper-nickel alloys are considered excellent material because of their inherent macrofouling resistance. However, ammonia as the working fluid in the CCVCS is not considered compatible with copper-nickel alloys as it attacks and thus degrades this material. A most significant degradation of the heat transfer system is caused by noncondensible gas generation from working fluids containing oxygen and hydrogen which adversely affects wicking action and condensation oxide film formation on tube surfaces, and erosion-corrosion particle formation.

Further, seawater fouling must be given great consideration. One method is the use of fouling resistant tube material alloys for all heat transfer surfaces. Another method is the use of an antifouling material coatings, such as, organo-metallic polymers. And yet another possible method of fouling control is the use of low levels of chlorination generated electrolytically from seawater. Concentrations as low as 0.2 parts per million are shown to effectively prevent macrofouling. Still other means such as the use of a mechanism consisting of collars attached to all bare areas where fouling can occur and, periodically actuating or sliding the collar along the fouled area thus pushing and cleaning any fouling off the fouled area. Other methods, such as, wave patterns can be used to break up the boundary layer of nearby seawater and to minimize laminar sublayer thus discouraging attachment of inorganic or organic aggregates, such as, bacteria, algae, or barnacles. Minimum requirements may be necessary, however, because the lack of sunlight at depth and forced convective flows of heat sink seawater on a configured CCVCS. Thus, fouling is also a necessary consideration in the selection of heat transfer material and in overall condenser and channel design.

The working fluid having high latent heat and liquid thermal conductivity is preferred. Other necessary concerns regarding the working fluid are: hydrodynamic performance factors, capillary pumping limit and the wicking height factor for wicked systems, and the kinematic viscosity ratio for the relative merit of the vapor phase. In some instances, two mixed fluids operate in the vapor and liquid states better than either individually. In other instances, dual fluid systems are designed for adverse condition avoidance, such as, use of an antifreeze mixture such as ethylene glycol with water. However, in the direct-contact heat-exchanger CCVCS, the immiscibility of the working fluid with hot fresh water and carry over of one fluid with the other are fundamental concerns.

Concerns for selection of a working fluid in an underwater vehicle are both engineering and environmental. For example, its ability to be removed from the atmosphere in the event of system leakage and possible make-up addition need, toxic and carcinogenic limits, flammability and explosive limits, fluid preparation requirements (outgassing, impurities removal, etc.) prior to system fill and to any make-up additions, pressure of containment, compatibility of the exposed system materials with the working fluid (corrosion, erosion, oxide formation, gas generation, etc.), welding and sealing temperature of joints compared to the critical temperature of the fluid, potential effects of inleakage from underwater vehicle atmosphere, and effects of periods of time of system inactivity during construction, layups, maintenance, etc. Water, a choice fluid for safety, has a low vapor pressure and thus is in the CCVCS range of interest. Such a CCVCS system, using water, would operate under vacuum and would require very large penetrations. The fluoro-chloro hydrocarbon refrigerants, such as, R-22, R-13B1, R-12, R500, or R502, are viable alternatives which would operate above atmospheric pressure. Some CCVCS working fluids are illustrated in Table 1 showing other necessary compatible parameters.

TABLE 1

| FLUID | USEFUL RANGE, °F. | COMPATIBLE VESSEL/WICK MATERIALS | ADVANTAGES | LIMITATIONS |
|---|---|---|---|---|
| Water | 32 to 400 | Copper, Titanium Aluminized Steel | Highest Heat Transfer, Non-toxic | Freezing, low vapor pressure (Low Sonic Limit) |
| Acetone | −40 to 250 | CuNi ?, SS, Cu | Moderate Performance | Flammable |
| Ammonia | −75 to 250 | Aluminum, Steels | High Performance | Toxic, Flammable, High Pressure |
| R-11 | −75 to 300 | CuNi, Cu, Brasses, Steels | Non-Toxic | |
| R-114 | −100 to 100 | CuNi, Cu, Brasses, Steels | Non-Toxic | |
| Methanol | −60 to 300 | Copper, CuNi ? | Good Reflex Power | Flammable, Toxic |
| Ethanol | −20 to 250 | Copper, CuNi ? | | Flammable, Poorer than Methanol Drinking Temptation |

? = Fluid-material compatibility in question.

A simplified system cycle diagram for the CCVCS for an underwater vehicle's auxiliary machinery and equipment cooling system contains three cooling loops. The freshwater of a first loop heats the vaporization system working fluid in the CCVCS evaporator reservoir section via a heat exchanger. The vaporization system working fluid circulates through a second loop, passing out the hull penetration as a vapor condensing in the CCVCS condenser means, and returning through the hull penetration to the evaporator reservoir as liquid with or without pump assist. A third loop is the heat sink chamber means loop. The seawater cools the condenser either by buoyancy-induced natural convection or by pump-assisted forced convection using flush intakes or scoops for injection when the underwater vehicle is moving through the water. The second loop of the system is referred to as the heat pipe or the vaporization cooling system. It can be gravity driven, compressor assisted, or pump assisted. The selection of system configuration depends upon type underwater vehicle, heat load, and efficiency required. Natural convection heat transfer coefficients are low and require large bundles of condenser tubes manifolded from headers for rejecting heat to the seawater. A pump or scoop injected condenser heat sink chamber has a much higher forced convective coefficient causing a smaller tube bundle size. However, forced convective heat sink chambers are noisier than free convective heat sink chambers and such must be considered in any specific design requirement.

The sonic limit and subsonic heat transport are also necessary parameters to be considered in such a CCVCS system. The maximum theoretical power that can be transferred through a penetration by vaporization heat transfer is determined by the cross-sectional area of the penetration and the sonic limit equation. The ultimate heat pipe limit is reached when the vapor reaches sonic velocity. Sonic velocity and the associated maximum axial heat flux at a particular temperature varies significantly for each working fluid. Table 2 shows working fluids wherein the heat flux at sonic velocity is computed at 34.4° C., a typical auxiliary seawater system heat rejection temperature.

TABLE 2

| | HEAT FLUX KILOWATTS/CM$^2$ | VAPOR DIAMETER (IN INCHES) REQUIRED FOR VAPRO AT SONIC LIMIT FOR 2.3 × 10$^6$ BTU/HR |
|---|---|---|
| Ammonia | 201 | 0.82 |
| Methanol | 5.9 | 4.76 |
| Ethanol | 3.6 | 6.09 |
| Water | 1.9 | 8.39 |
| R-11 | 9.6 | 3.73 |
| R-114 | 17.3 | 2.78 |
| Acetone | 5.1 | 5.12 |

The heat pipe system in practical operation operates at fractional heat loads of the hydrodynamic or sonic heat flux limits. Such system is a thermal conductor of extremely high thermal conductance. Also, such system's internal conductance is a composite of the radial heat transfer at the evaporator and condenser areas and of the axial vapor mass transport and must be distinguished from the conductances between the heat pipe and the environment. It is important in heat pipe system design to note that overall conductance is limited by the input and output conductances, that is, heat addition at the evaporator and heat rejection at the condenser and that thermal conductance is the inverse of thermal resistance. Such parameters are required to be kept in mind in a specific design for a specific underwater vehicle and its use.

A further parameter for accurately designing a CCVCS is to review the maximum heat transport capacity of a system by balancing all fluid driving forces against all pressure drops in the vapor and condensate flow avenues.

Many obvious modifications in the details and arrangements of parts may be made, however, without departing from the true spirit and scope of the invention, as more particularly defined in the appended claims.

What is claimed is:

1. A closed-cycle vaporization cooling system (CCVCS) for an underwater vehicle's auxiliary inner-to-outer hull heat transfer comprising:

a low pressure fluid circulating loop means for collecting and cooling waste heat from various machinery and equipment in said underwater vehicle's auxiliary cooling system;

an evaporator reservoir means configured so as to operate under all conditions of said underwater vehicle's motion and being a pressure vessel located inside said underwater vehicle, and having a bundle of manifolded heat pipe evaporator tubes for transferring heat from said hot fluid to said heat pipes working fluid through its manifolded evaporator section means;

an adiabatic zone means located between said evaporator means and a condenser means located outside the underwater vehicle's pressure hull for conveying vaporized working fluid to said condenser means;

a condenser means located external to said pressure hull of the underwater vehicle and contained within a free-flooded seawater hull shaped heat sink reservoir having access to the outer hull with said access being louvered in the fore and aft directions for transferring heat to the seawater from said working fluid;

a condensate means located partially within said condenser means for condensing and returning said condensate to said evaporator means; and said adiabatic zone means and said condensate means penetrating the hull through one point of penetration.

2. A closed-cycle vaporization cooling system for underwater vehicle auxiliary inner-to-outer hull heat transfer as in claim 1 wherein said low pressure fluid circulating loop means is an integral part of said evaporator means.

3. A closed-cycle vaporization cooling system for an underwater auxiliary inner-to-outer hull heat transfer as in claim 1 wherein said evaporator means is oriented such that its bottom is angled below the horizontal to enable gravity to assist return of the condensate from all underwater vehicle operational angles.

4. A closed-cycle vaporization cooling system for an underwater vehicle auxiliary inner-to-outer hull heat transfer as in claim 3 wherein said working fluid is vaporized in said heat pipe evaporator tubes of said evaporator reservoir means and then converges into a common header connector to said adiabatic zone means.

5. A closed-cycle vaporization cooling system for an underwater vehicle auxiliary inner-to-outer hull heat transfer as in claim 3 wherein said working fluid is under steady-state conditions and constantly vaporizing as heat is transferred through said bundle of manifolded heat pipe tubes containing circulating hot fluid.

6. A closed-cycle vaporization cooling system for an underwater vehicle auxiliary inner-to-outer hull heat transfer as in claim 1 wherein said adiabatic zone means contains a hull valve for additional safety for said system.

7. A closed-cycle vaporization cooling system for an underwater vehicle auxiliary inner-to-outer hull heat transfer as in claim 1 wherein said condenser means comprises a condenser header and condenser branch pipes.

8. A closed-cycle vaporization cooling system for an underwater vehicle auxiliarly inner-to-outer hull heat transfer as in claim 7 wherein said condenser header is a thermosyphon main header with a wicked condenser manifold and interfaced with an array of internal channels or wicked branch tubes.

9. A closed-cycle vaporization cooling system for an underwater vehicle auxiliary inner-to-outer hull heat transfer as in claim 1 wherein said recessed or external free-flooded seawater heat sink reservoir encompassing said condenser means operates with a chimney effect where cold seawater is drawn in at the louvered bottom and flows up a channel inside said heat sink reservoir by natural or forced convection and flows out through the louvered chimney top.

10. A closed-cycle vaporization cooling system for an underwater vehicle auxiliary inner-to-outer hull heat transfer as in claim 1 wherein said liquid condensate means further comprises a flow separation baffle plate for flow separation, and a small diameter tube located at the bottom of the condensate means for separating liquid and vapor flow and returning said liquid to said evaporator means.

11. A closed-cycle vaporization cooling system for an underwater vehicle auxiliary inner-to-outer hull heat transfer as in claim 1 wherein said system may be in multiple units in whole or in part as required for an underwater vehicle's inner-to-outer hull heat transfer.

12. A closed-cycle vaporization cooling system for an underwater vehicle auxiliary inner-to-outer hull heat transfer as in claim 1 wherein said system includes means for providing forced sea water circulation within said system.

13. A closed-cycle vaporization cooling system for an underwater vehicle auxiliary inner-to-outer hull heat transfer as in claims 7 and 8 wherein condenser branch pipes are angled from the horizontal or vertical.

14. A closed-cycle vaporization cooling system for an underwater vehicle auxiliary inner-to-outer hull heat transfer as in claim 1 wherein said hot fluid is fresh water.

* * * * *